United States Patent [19]

Lodrick, Sr.

[11] Patent Number: 4,925,169

[45] Date of Patent: May 15, 1990

[54] CLAMP WITH FAST-ACTING, ONE-HAND ADJUSTMENT

[76] Inventor: Lawrence E. Lodrick, Sr., 2436 Harrison Ave., North Rochester, Mich. 48063

[21] Appl. No.: 171,886

[22] Filed: May 9, 1988

Related U.S. Application Data

[62] Division of Ser. No. 16,855, Feb. 20, 1987, Pat. No. 4,753,427.

[51] Int. Cl.[5] ..... B25B 1/02

[52] U.S. Cl. ..... 264/185; 269/221; 269/225; 269/249; 74/89.15; 74/424.8 R

[58] Field of Search ..... 269/184–187, 269/172, 202, 221, 224, 225–227, 249, 3, 6; 74/89.15, 424.8 R, 109, 625, 479, 665 B

[56] References Cited

U.S. PATENT DOCUMENTS

| | | | |
|---|---|---|---|
| 568,364 | 9/1896 | McIntyre | 269/185 |
| 710,861 | 10/1902 | Haas . | |
| 885,191 | 4/1908 | Smith . | |
| 948,980 | 2/1910 | Tischler . | |
| 986,464 | 3/1911 | Jack . | |
| 1,141,715 | 6/1915 | Kish | 269/185 |
| 1,262,300 | 4/1918 | Blake . | |
| 1,716,887 | 6/1929 | Griesell . | |
| 2,138,245 | 1/1938 | Smith | 269/185 |
| 2,156,195 | 4/1939 | Robillard | 144/305 |
| 2,453,656 | 11/1948 | Bullard | 74/104 |
| 2,512,696 | 6/1950 | Tappert | 74/435 |
| 2,546,336 | 3/1951 | Gibbons | 144/305 |
| 2,565,965 | 8/1951 | Hartmann | 81/26 |
| 2,666,334 | 1/1954 | Nalle | 74/424.8 R |
| 2,768,664 | 10/1956 | Morgan | 144/305 |
| 3,063,708 | 11/1962 | Wollenhaupt | 269/224 |
| 3,357,698 | 12/1967 | Flynn | 269/221 |
| 3,824,420 | 7/1974 | Stegeman et al. | 74/429.8 R |
| 3,893,813 | 7/1975 | Johnson | 23/292 |
| 4,185,811 | 1/1980 | Long | 269/6 |
| 4,220,322 | 9/1980 | Hobday | 269/6 |
| 4,436,294 | 3/1984 | Irelan | 269/6 |
| 4,478,103 | 10/1984 | Benjamin | 74/89.15 |
| 4,582,307 | 4/1986 | Wang | 269/182 |

FOREIGN PATENT DOCUMENTS

| | | | |
|---|---|---|---|
| 453483 | 12/1927 | Fed. Rep. of Germany | 46/13 |

*Primary Examiner*—Robert C. Watson

*Attorney, Agent, or Firm*—Basile and Hanlon

[57] ABSTRACT

The clamp includes a member having an anvil at one end and a threaded bore at another end with a longitudinal bore axis directed at the anvil. A rod having a threads and a longitudinal splines is threadingly disposed within the threaded bore. The rod has a first end, preferably with a handle, and a second end, preferably with a shoe, facing the anvil. A gear matingly engageable with the splines on the rod is rotatably held to the member by a fastener through a central bore. The gear intertwines with the splines on the rod, such that movement of the gear in one direction rotates the rod in an to threadingly move the rod through the bore along the longitudinal axis of the rod. A second embodiment of the clamp includes a member having an anvil at one end and a bore at another end with a longitudinal bore axis directed at the anvil. A rod having a plurality of threads and a pair of longitudinally extending, generally smooth surfaces is disposed within the bore. The rod has a first end, preferably with a handle, and a second end, preferably with a shoe, facing the anvil. A driving member with a threaded bore threadingly engages the threads on the rod. The threaded driving member is retained adjacent to the bore of the member and a pair of walls slidingly engage the pair of smooth surfaces on the rod to bias the rod against rotational movement while permitting longitudinal movement of the rod.

13 Claims, 4 Drawing Sheets

CLAMP WITH FAST-ACTING, ONE-HAND ADJUSTMENT

This application is a division, of application Ser. No. 07/016,855, filed Feb. 20, 1987 now Pat. No. 9,753,427.

BACKGROUND OF THE INVENTION

I. Field of the Invention

The invention relates to clamping devices and, more particularly, to clamps having quickly adjustable parts, in which the clamp has a threaded spindle within a threaded bore allowing adjustment of the spindle to a position adjacent the workpiece for clamping.

II. Description of the Prior Art

In general, clamping devices and, more particularly, quick-acting assemblies for clamping members are known in the art. For examples, see U.S. Pat. Nos. 4,582,307; 4,220,322; 4,436,294; 4,185,811; 3,893,813; 3,357,698; 2,768,664; 2,546,336; 2,565,965; 2,156,195; 1,716,887; 1,262,300; 986,464; 948,980; 885,191; 710,861; and German Pat. No. 453,483.

The majority of these prior devices use pivotable elements, sometimes biased with springs, to permit the spindle to be moved longitudinally without rotatably threading the spindle through the threaded portion of the clamp. Other prior art devices use rods or bars, sometimes having gear teeth thereon, which are movable against the workpiece and held in place by a clutch mechanism or some other locking device.

It would be desirable to provide a clamping device with the holding strength and simplicity of a threaded spindle, while providing means for rapid, one-hand adjustment without unduly complicating the manufacturing or use of the clamp, thereby maintaining its economy and simplicity.

SUMMARY OF THE INVENTION

The present invention relate to a clamping device. The clamp has a member with an anvil at one end and a threaded bore at another end. The threaded bore has a longitudinal bore axis directed at the anvil. A matingly threaded rod is engaged within the threaded bore. The rod has a first end, preferably with a handle, and a second end, preferably with a shoe, facing the anvil. A plurality of longitudinally parallel gear teeth are interposed on the threaded rod. The clamp has gear means attached to the member and intermeshing with longitudinally parallel gear teeth on the threaded rod for rotationally driving the threaded rod longitudinally through the threaded bore to provide rapid adjustment. A fastener rotatably holds the gear means, preferably a thumb gear, to the member through a central bore in the thumb gear, with the thumb gear intertwining with the gear teeth on the rod, wherein rotating the thumb gear in one direction rotationally drives the rod in an opposite direction to move the rod through the threaded bore.

Another embodiment of the present clamp includes a member with an anvil at one end and a bore at another end with a longitudinal axis directed at the anvil. A rod having threads is engaged within the bore. The rod has a first end, preferably with a handle, and a second end, preferably with a shoe, facing the anvil. The clamp has threaded means, matingly engageable with the threads on the rod, for longitudinally driving the rod through the bore. The clamp also includes fastener means for retaining the driving means adjacent the bore of the member. Restraining means are provided in the second embodiment of the clamp for biasing the rod against rotational movement while permitting longitudinal movement of the rod through the bore.

BRIEF DESCRIPTION OF THE DRAWINGS

In the drawings, like reference numerals refer to the same elements throughout the various views, and wherein.

DETAILED DESCRIPTION OF THE PREFERRED EMBODIMENTS

Figure 1:
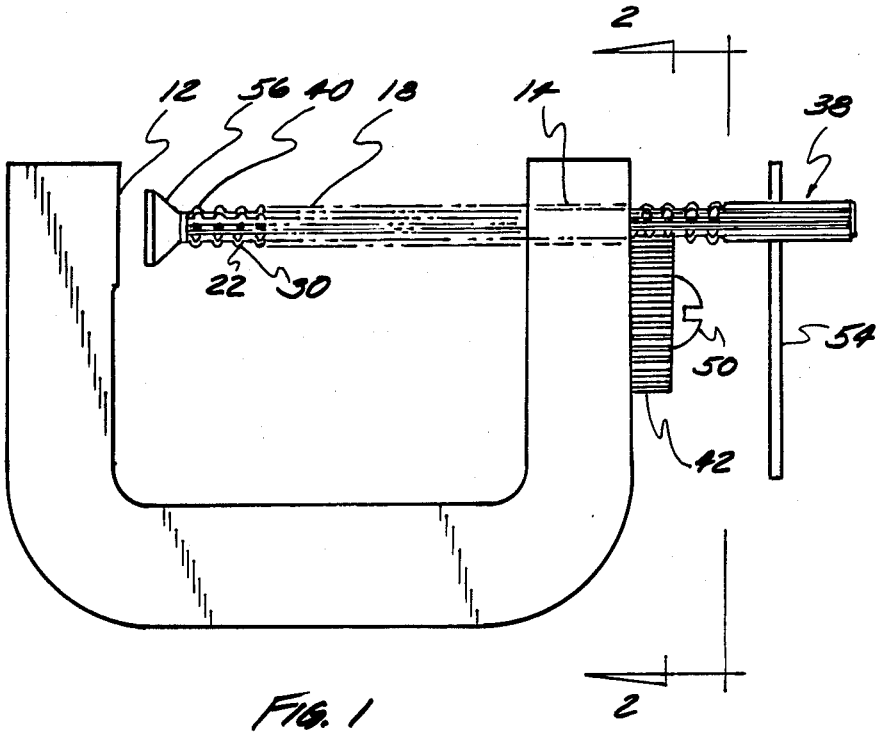
FIG. 1 is a side view of the clamp with a fastacting, gear driven adjustment.

Referring now to FIG. 1, a clamp is shown having a member 10 with an anvil 12 at one end and a threaded bore 14 at another end. The threaded bore 14 has a longitudinal bore axis directed at the anvil 12. A rod 18, with a rod diameter d has a plurality of threads 22 on the outer surface. the rod 18 also has a plurality of longitudinally parallel gear teeth 30 interposed on the plurality of threads 22. The rod 18 has a first end 38 and a second end 40. The second end 40 has a shoe 56, preferably a pivotable shoe, attached to the end and facing the anvil 12. The first end 38 has a handle 54 to facilitate tightening the workpiece between the shoe 56 and the anvil 12. The handle 54 can be permanently attached, or removably attached, and can be any variety of configurations, such as a straight handle as shown or a wing nut shaped handle or any equivalent thereof. The handle 54 generally provides additional leverage to threadingly tighten the workpiece between the shoe 56 and the anvil 12.

Figure 2:
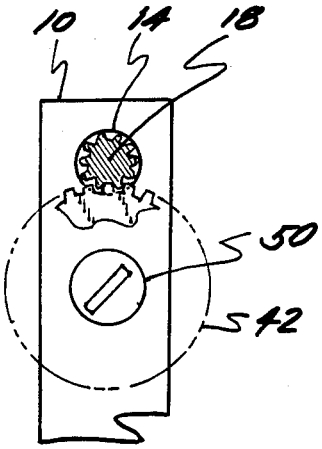
FIG. 2 is a sectional view showing the thumb gear interaction with the gear teeth on the threaded rod.

FIG. 2 is a partial section showing a gear 42 intertwining with the gear teeth 30 on the rod 18. The gear 42 preferably has a larger diameter D than the diameter d of the rod 18. The larger diameter of the gear 42 provides a mechanical advantage in that the rod 18 will preferably have fewer gear teeth, thereby assuring the rod 18 will be rotationally driven through more revolutions than the gear 42. The gear 42 also preferably extends beyond the edge of the member 10 such that the outer edge of the gear 42 can be manually or automatically manipulated to cause rotation of the gear 42 and corresponding rotation of rod 18.

Figure 3:
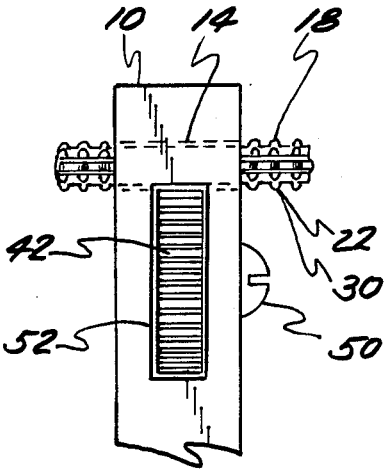
FIG. 3 is a partial side view showing an alternative placement of the thumb gear in relation to the member.

FIG. 3 shows an alternative placement of the gear 42 within a slot 52 formed in the member 10 which is in communication with the threaded bore 14. The slot 52 is of sufficient size to house the gear 42 with an outer portion of the gear 42 extending externally from the member 10 a sufficient distance for manual or automatic rotation of the gear 42. Preferably, the gear 42 has a longitudinal height at least equal to a plurality of threads 22 on the rod 18 in this configuration or in the configuration as shown in FIG. 1 or any equivalent configuration. As previously described, the gear 42 is rotatably held in place by a fastener 50 passing through the central bore 46 of the gear 42.

Figure 15:
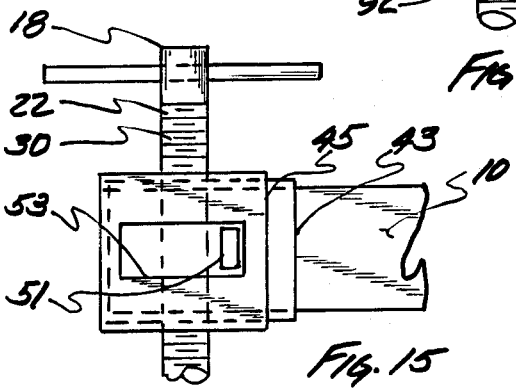
FIG. 15 is a partial side view of the clamp with a fast-acting, gear driven adjustment showing a straight or rat gear configuration.
Figure 16:
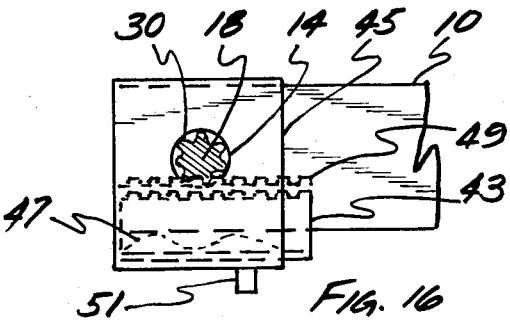
FIG. 16 is a partial top view of the clamp shown in FIG. 15.
Figure 17:
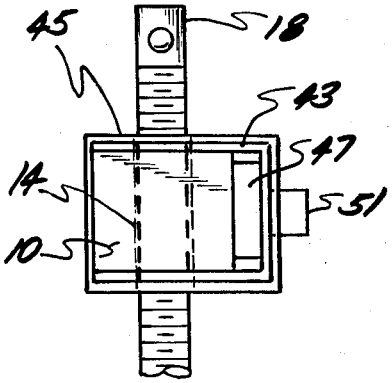
FIG. 17 is a partial side view of the clamp shown in FIG. 15.

It should be noted that the circular gear 42, as shown in FIGS. 1 through 3, can be replaced by a straight or rack gear 43 engageable with the longitudinally parallel gear teeth 30, as shown in FIGS. 15 through 17. The straight or rack gear 43 can be driven in one direction to cause clockwise rotation of the rod 18, while driving the straight or rack gear 43 in the opposite direction would cause counterclockwise rotation of the rod 18. The straight or rack gear 43 can be housed within slot 52 formed in the member 10. In the alternative, fastener means for retaining the straight or rack gear 43 adjacent to the member 10 can be provided, allowing sliding movement of the straight or rack gear 43 along a path perpendicular to the longitudinal axis of the rod 18.

The fastener means, such as fastener 45 shown in FIGS. 15 through 17, can include an aperture 53 as shown in FIG. 15 to provide access to a push-pull tab 51 extending outwardly from the straight or rack gear 43. A biasing means, such as a leaf spring 47 as shown in FIGS. 16 and 17, is disposed between the straight or rack gear 43 and the member 10 for urging the straight or rack gear 43 normally away from engagement with the longitudinally parallel gear teeth 30 on the rod 18. The biasing means allows movement of the gear 43 along the path perpendicular to the longitudinal axis of the rod 18 without engaging the longitudinally parallel gear teeth 30 on the rod 18, while permitting movement of the straight or rack gear 43 along the path perpendicular to the longitudinal axis of the rod 18 while engaging the longitudinal parallel gear teeth 30 on the rod 18 when an external force on the straight or rack gear 43 overcomes the urgings of the biasing means as shown in phantom at numeral 49 in FIG. 16.

Figure 13:
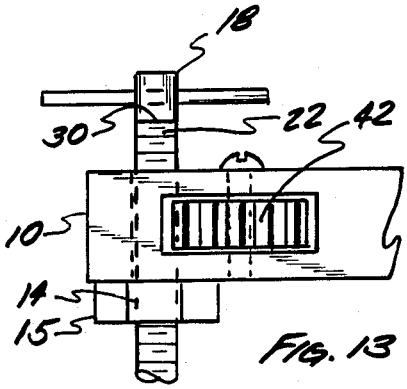
FIG. 13 is a partial side view of the clamp with a fast-acting, gear driven adjustment showing an alternative for the threaded portion of the bore.
Figure 14:
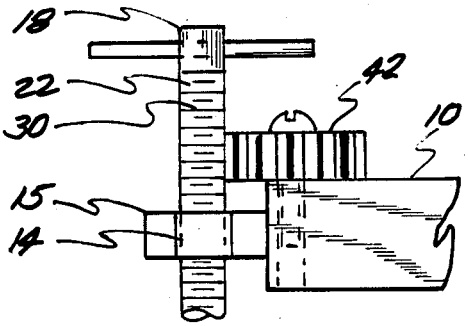
FIG. 14 is a partial side view of the fast-acting, gear driven adjustment showing another alternative for the threaded portion of the bore.
Figure 18:
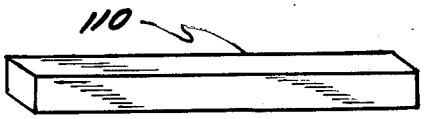
FIG. 18 is a perspective view of a section of bar stock cut to a selected length.
Figure 19:
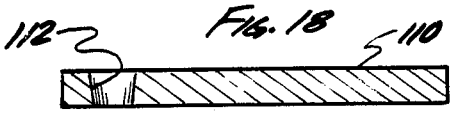
FIG. 19 is a cross-sectional view of the section of bar stock showing an aperture punched adjacent to one end.
Figure 20:
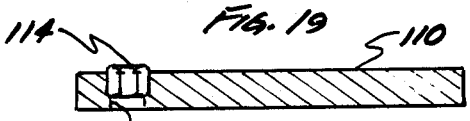
FIG. 20 is a cross-sectional view of the section of bar stock with a nut press fitted into the aperture.
Figure 21:
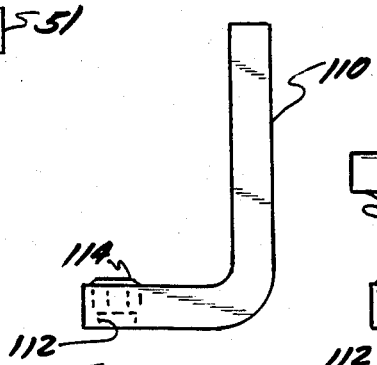
FIG. 21 is a side view of the section of bar stock after being bent into an L-shape.
Figure 22:
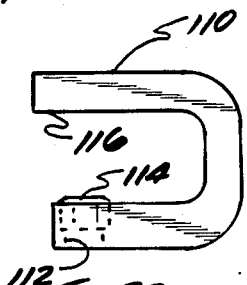
FIG. 22 is a side view of the section of bar stock after being bent a second time into a C-shape.
Figure 23:
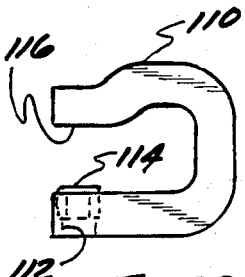
FIG. 23 is a side view of the section of bar stock after being bent to form a raised anvil on the C-shaped clamp.

Another alternative configuration is shown in FIGS. 13 and 14, where the threaded bore 14 is the internal threaded portion of a nut 15 which is affixed to the member 10 by any suitable means, for example, such as by welding. The nut 15 can be aligned with a bore 13 through the member 10, as shown in FIG. 13, or in the alternative the nut 15 can be welded directly to the member 10 as shown in FIG. 14. In addition, a clamp can be constructed from a portion of bar stock 110 cut to a preselected length as shown in FIG. 18. An aperture 112 is punched through the bar stock 110 adjacent to one end as shown in FIG. 19. A nut 114 having a threaded internal bore can then be press fitted into the aperture 112 previously punched into the section of bar stock 110, as shown in FIG. 20. The bar stock 110 is then struck adjacent the nut 114 to deform the material adjacent the aperture 112, thereby securing the nut 114 in place within the aperture 112. The bar stock 110 is then formed into the desired C-shaped clamp by successive bending operations as shown in FIGS. 21 and 22. In FIG. 21, a first 90-degree bend of the bar stock 110 is made adjacent to the one end of the bar stock 110 at a preselected distance from the one end. As shown in FIG. 22, a second bend is made in the bar stock 110 at a second preselected distance from the second end of the bar stock 110 such that the surface 116 of the bar stock at the second end forms the anvil of the C-shaped clamp and is in facing relationship to the opening of the aperture 112 into which the nut 114 was previously press fitted. A raised anvil can also be formed by further successive bending of the C-shaped clamp as shown in FIG. 23. After forming the clamp as previously described, a threaded rod, 18 or 64, may be inserted through the press-fit nut 114 and a shoe 56 can be connected to one end of the rod facing the anvil 12, while a handle 54 is connected to the other end. At this point of construction, one of the fast-action mechanisms described in the present invention may be added to the clamp assembly if desired.

The method described above can be used for any bar stock material which has sufficient strength for clamping and is sufficiently ductile to permit bending and puching of the material. A variety of steel compositions would meet these requirements.

Alternatively, an aluminum composition could be extruded having the desired C-shape, and the extruded aluminum stock could then be cut to predetermined dimensions.

Figure 4:
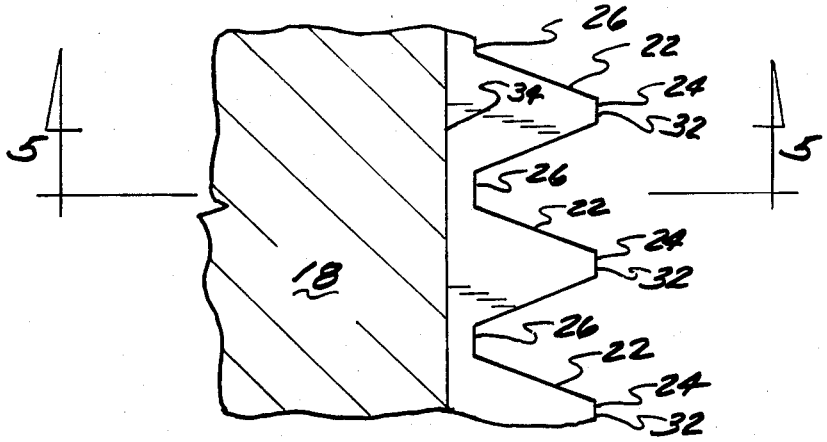
FIG. 4 is a detailed side view of the threaded rod with interposed gear teeth having a radial gear depth greater than the radial thread depth.

Referring now to FIG. 4, an enlarged, partial, cross-sectional side view of rod 18 is shown. The rod 18 has a plurality of threads 22. Each of the plurality of threads 22 has an outer thread edge 24 and an inner thread edge 26. A radial thread depth can be calculated by subtracting the radial distance to the inner thread edge 26 from the radial distance to the outer thread edge 24. The rod 18 also has a plurality of longitudinally parallel gear teeth 30. Each gear tooth has an outer gear edge 32 and an inner gear edge 34. A radial gear depth can be calculated by subtracting the radial distance to the inner gear edge 34 from the radial distance to the outer gear edge 32.

Figure 5:
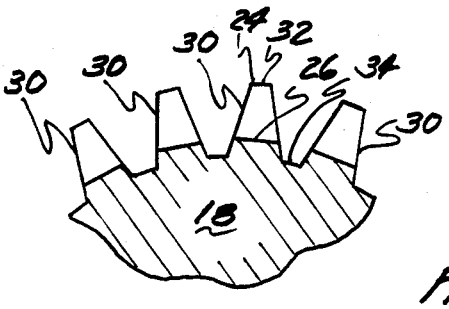
FIG. 5 is a partial, cross-sectional view as shown in FIG. 4.

FIG. 5 is a partial, cross-sectional view taken as shown in FIG. 4. FIG. 5 is a cross-sectional view taken perpendicular to the longitudinal axis of the rod 18 and shows the plurality of longitudinally parallel gear teeth 30 interposed on the plurality of threads 22.

Referring to FIGS. 4 and 5 together, it can be seen that in this particular configuration the radial gear depth is greater than the radial thread depth. Since a considerable portion of the surface area of the threads have been removed in forming the gear teeth in this embodiment, it is preferable to lengthen the threaded bore 14 for increased surface contact between the threads 22 and the threaded bore 14 which will promote greater strength.

Figure 7:
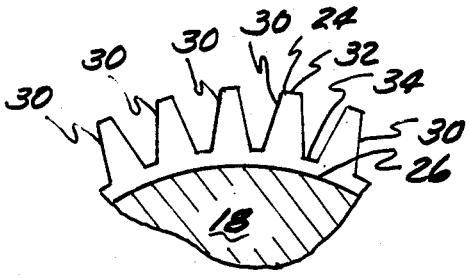
FIG. 7 is a partial, cross-sectional view taken as shown in FIG. 6.
Figure 6:
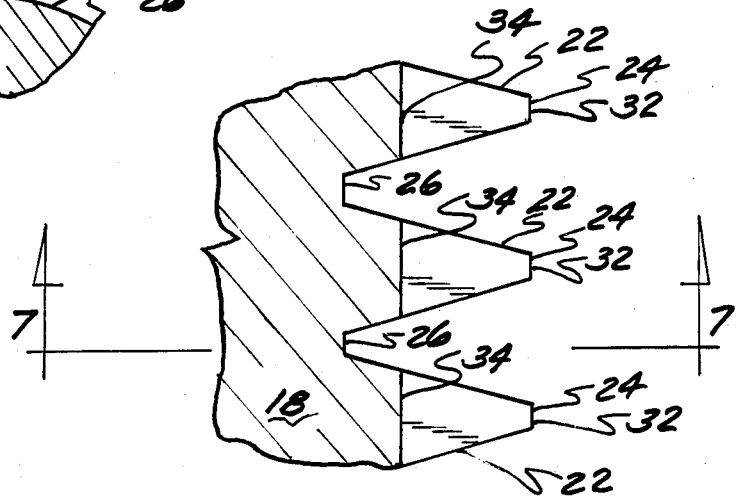
FIG. 6 is a partial side view of the threaded rod with interposed gear teeth having a radial gear depth less than the radial thread depth.
Figure 8:
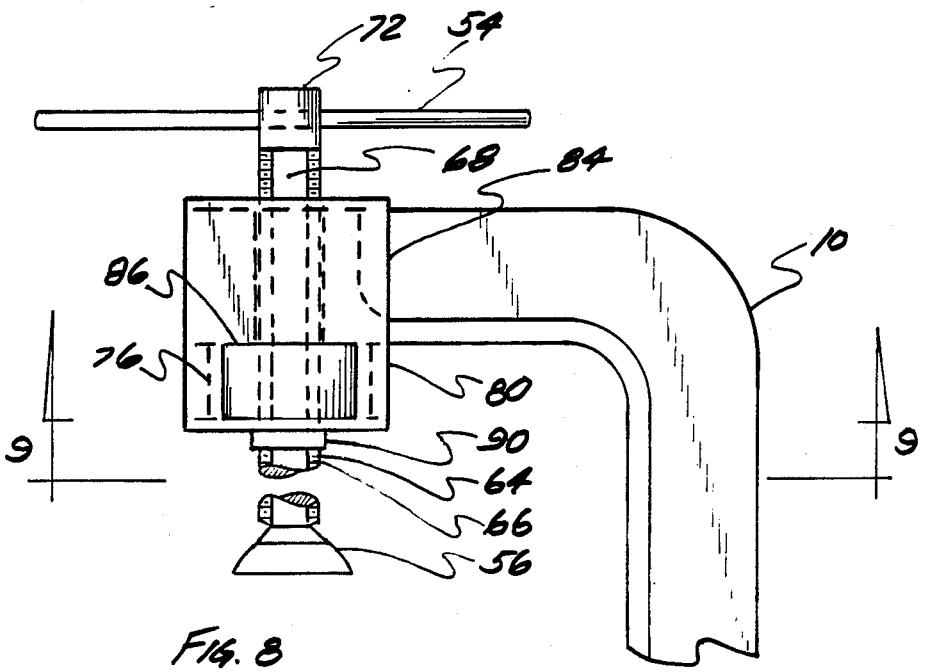
FIG. 8 is a partial side view showing a second embodiment of the present clamp with a fast-acting adjustment.
Figure 9:
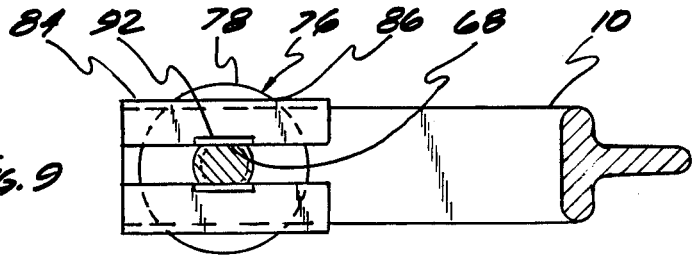
FIG. 9 is a cross-sectional view taken as shown in FIG. 8.
Figure 10:
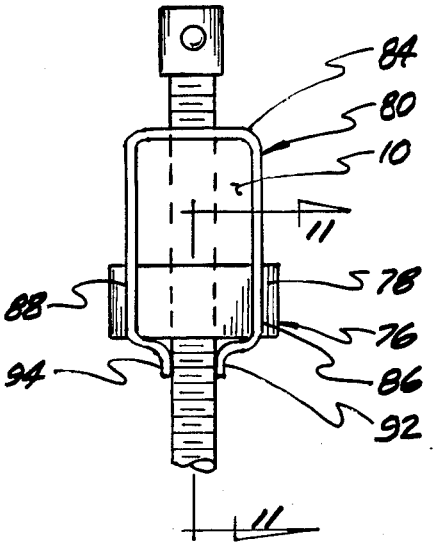
FIG. 10 is a partial side view of the second embodiment of the clamp as shown in FIG. 8.
Figure 11:
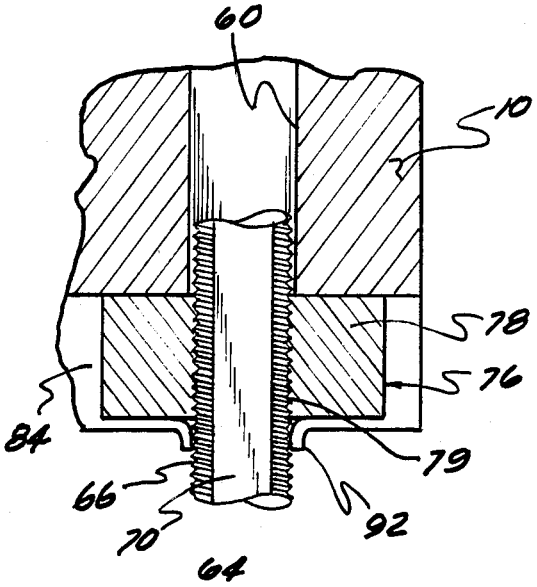
FIG. 11 is a partial, cross-sectional view taken as shown in FIG. 10.

In the alternative, as shown in FIGS. 6 and 7, the radial gear depth can be less than the radial thread depth to provide complete thread-to-thread surface contact between the rod 18 and the threaded bore 14 for increased strength without the need for lengthening the threaded bore 14. Another embodiment can provide a radial gear depth equal to the radial thread depth, in which case it is preferable to lengthen the threaded bore 14 to provide more surface-to-surface contact between the threads on the rod 18 and the threaded bore 14 for increased strength.

The invention disclosed above can generally be used in the following manner. A workpiece would be positioned between the anvil 12 of the member 10 and the shoe 56 on the rod 18. The user's thumb or some other driving force contacts the outer edge of the gear 42 causing rotation of the gear 42. The gear intertwines and acts on the plurality of longitudinally parallel gear teeth 30 on the rod 18 causing the rod 18 to rotate about its longitudinal axis, further causing longitudinal movement as the plurality of threads 22 on the rod 18 interact with the threaded bore 14. Depending upon the direction of rotation, the shoe 56 can be driven into contact with the workpiece or can be retracted away from the workpiece. The handle 54 can be used as necessary to further tighten the workpiece between the shoe 56 and the anvil 12 or, if necessary, to loosen a previously clamped workpiece.

A second embodiment of the clamp is shown in FIGS. 8 through 12. The clamp includes a member 10 with an anvil 12 at one end similar to the clamp shown in FIG. 1. At another end, the clamp has a bore 60 with a longitudinal bore axis directed at the anvil 12. A rod 64 has a plurality of threads 66 on the outer surface. The rod 64 has a first end 72 and a second end 74. The first end 72 has a handle 54. The handle 54 can be permanently attached, or removably attached, and can be any variety of configurations, such as a straight handle as shown or a wing nut shaped handle or any equivalent thereof. The handle 54 generally provides additional leverage to threadingly tighten the workpiece between the shoe 56 and the anvil 12. The second end 74 of the rod 64 has a shoe 56, preferably a pivotable shoe, attached to the end facing the anvil 12.

The clamp includes threaded means 76, matingly engageable with the plurality of threads 66 on the rod 64, for longitudinally driving the rod 64 through the bore 60. The threaded means 76 for longitudinally driving the rod 64 can comprise a driving member 78 having a threaded bore 79 matingly engageable with the plurality of threads 66 on the rod 64, such that the rod 64 threadingly engages within the threaded bore 79 of the driving member 78.

Figure 12:
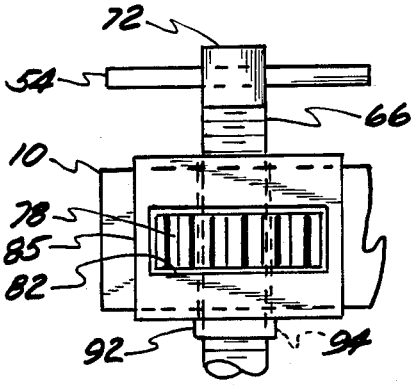
FIG. 12 is a partial side view showing an alternative placement of the driving means with respect to the member.

Fastener means 80 for retaining the threaded driving means 76 adjacent to the bore 60 in the member 10 are also provided. The fastener means 80 for retaining the threaded driving means 76 can comprise the member 10 having a slot 82 in communication with the bore 60, as shown in FIG. 12. The slot 82 is of sufficient size to house the threaded driving means 76, such as driving member 78, within the slot 82 with the threaded driving means 76 extending externally from the member 10 a sufficient distance for rotational manipulation.

In the alternative, the fastener means 80 for retaining the threaded driving means 76 can comprise a clip 84 engageable with the member 10, as shown in FIGS. 8 through 11. The clip 84 can be of generally C-shaped configuration with the outer ends of the C-shaped clip biased toward each other, such that when the clip 84 is positioned around the periphery of the member 10, the biasing of the clip 84 firmly grips the member 10. The clip 84 has a pair of opposing retaining slots, 86 and 88 respectively. The pair of opposing retaining slots, 86 and 88, are of sufficient size to house the threaded driving means 76, such as driving member 78, within the pair of opposing retaining slots and externally from the member 10. The threaded driving means 76, such as driving member 78, extends externally from the clip 84 a sufficient distance for rotational manipulation.

The clamp also includes restraining means 90, engageable with the rod 64, for biasing the rod 64 against rotational movement while permitting longitudinal movement of the rod 64. The rod 64 can include a pair of longitudinally extending, generally smooth surfaces, 68 and 70 respectively. The pair of longitudinally extending, generally smooth surfaces, 68 and 70 respectively, are preferably disposed parallel to one another and are also preferably flat surfaces. With this configuration of the rod 64, the restraining means 90 can comprise a pair of walls, 92 and 94 respectively, extending from the clip 84 in sliding engagement with the pair of longitudinally extending, generally smooth surfaces, 68 and 70 respectively, of the rod 64. In the alternative, the restraining means 90 can comprise a restraining clip 85, as shown in FIG. 12, engageable with the member 10 having a pair of walls, 92 and 94 respectively, engaging the rod 64 with sufficient force to bias the rod 64 against rotational movement while permitting longitudinal movement of the rod 64 without the aid of surfaces 68 and 70 on the rod 64 as previously described. As shown in FIG. 12, a slot 82 can retain the threaded driving means 76 adjacent to the bore 60, to replace the pair of opposing retaining slots, 86 and 88 respectively, of the clip 84.

The second embodiment of the invention disclosed above can genreally be used in the following manner. A workpiece can be positioned between the anvil 12 of the member 10 and the shoe 56 on the rod 64. The user's thumb or some other driving force contacts the outer surface of the threaded driving means 76 causing rotation of the threaded driving means 76. The threaded driving means 76 rotates, while the restraining means 90 biases the rod 64 against rotational movement, thereby causing the rod 64 to move longitudinally as the plurality of threads 66 on the rod 64 are threadingly engaged by the threaded driving means 76, such as the threaded bore 79 of the driving member 78. Depending on the direction of rotation, the shoe 56 can be driven into contact with the workpiece or can be retracted away from the workpiece. The handle 54 can be used as necessary to further tighten the workpiece between the shoe 56 and the anvil 12 or, if necessary, to loosen a previously clamped workpiece. When the handle 54 is used to further tighten the workpiece between the shoe 56 and the anvil 12, the biasing action of the restraining means 90 may be overcome to rotationally turn the rod within the threaded driving means to tightly clamp the workpiece.

While the invention has been described in connection with what is presently considered to be the most practical and preferred embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures.

What is claimed is:

1. A clamp comprising:

a member having an anvil at one end and at another end a bore with a longitudinal axis directed at the anvil;

a rod having threads, a first end and a second end, wherein the rod engages within the bore with the second end facing the anvil;

handle means connected to the first end of the rod for rotating the rod;

threaded means, matingly engagable with the threads on the rod, for longitudinally driving the rod through the bore as the threaded means is rotated with respect to the rod and the member, the threaded means permitting rotation of the rod with respect to the member and the threaded means for longitudinally moving the rod through the bore as the rod is rotated by the handle;

single means for restraining the threaded driving means adjacent the bore of the member and for biasing the rod against rotational movement while permitting longitudinal movement of the rod as the threaded means is rotated with respect to the rod and the member, the single means permitting rotation of the rod with respect to the member and the threaded means by rotating the handle to overcome the bias of the single means for longitudinally moving the rod through the bore as the rod is rotated.

2. The clamp of claim 1, further comprising said rod having a pair of longitudinally extending, generally smooth surfaces and said restraining means engageable with the longitudinally extending surfaces of the rod for biasing the rod against rotational movement while allowing longitudinal movement of the rod.

3. The clamp of claim 1, wherein the threaded means for longitudinally driving the rod futher comprises:

a driving member having a threaded bore matingly engageable with the threads on the rod, wherein the rod threadingly engages within the threaded bore of the driving member.

4. The clamp of claim 1, wherein the fastener means for retaining the threaded driving means comprises:

the member having a slot in communication with the bore and of sufficient size to house the threaded driving means within the slot with the threaded driving means extending externally from the member a sufficient distance for rotational manipulation.

5. The clamp of claim 4, wherein the restraining means further comprises:

a clip engageable with the member having a pair of walls slidingly engaging the rod to bias the rod against rotational movement while permitting longitudinal movement of the rod.

6. The clamp of claim 1, wherein the fastener means for retaining the driving means further comprises:

a clip engageable with the member having a pair of opposing retaining slots of sufficient size to house the threaded driving means within the pair of opposing retaining slots externally from the member with the threaded driving means extending externally from the clip a sufficient distance for rotational manipulation.

7. The clamp of claim 6, wherein the restraining means further comprises:

a pair of walls extending from the clip in sliding engagement with the rod to bias the rod against rotational movement while permitting longitudinal movement of the rod.

8. The clamp of claim 1, wherein the restraining means further comprises:

a clip engageable with the member having a pair of walls slidingly engaging the rod to bias the rod against rotational movement while permitting longitudinal movement of the rod.

9. A clamp comprising:

a member having an anvil at one end and at another end a bore with a longitudinal axis directed at the anvil;

an elongated rod having threads, a first end and a second end, wherein the rod engages within the bore of the member with the second end facing the anvil;

handle means connected to the first end of the rod for rotating the rod;

rotatable threaded means, matingly engagable with the threads on the rod, for longitudinally driving the rod through the bore as the threaded means is rotated with respect to the member, the threaded means permitting rotation of the rod with respect to the member as the handle means is rotated for longitudinally moving the rod through the bore as the rod rotates; and single means for retaining the rotatable threaded means adjacent the bore of the member and for biasing the rod against rotational movement while driving the rod longitudinally through the bore as the threaed means is rotated with respect to the member, the single means permitting rotation of the rod with respect to the member as the handle means is rotated to overcome the bias of the single means for longitudinally moving the rod through the bore as the rod rotates.

10. The clamp of claim 9, wherein the means for retaining comprises:

a clip engagable with the member having a pair of opposing retaining slots of sufficient size to house the threaded means within the pair of opposing retaining slots externally from the member with the threaded means extending externally from the clip a sufficent distance for rotational manipulation.

11. The clamp of claim 9, wherein the threaded means comprises:

a driving means having a threaded bore matingly engagable with the threads on the rod, wherein the rod threadingly engages within the threaded bore of the driving member.

12. The clamp of claim 9, wherein the single means comprises:

the member having a slot in communication with the bore and of sufficient size to house the threaded means within the slot with the threaded driving means extending externally from the member a sufficient distance for rotational manipulation.

13. A clamp comprising:

a member having an anvil at one end and at another end a bore with a longitudinal axis directed at the anvil;

an elongated rod having threads, a first end and a second end, wherein the rod engages within the bore of the member with the second end facing the anvil;

handle means connected to the first end of the rod for rotating the rod;

a rotatable driving member having a threaded bore matingly engagable with the threads on the rod, wherein the rod threadingly engages within the threaded bore of the driving member for longitudinally driving the rod through the bore as the driving member is rotated with respect to the member, the driving member also permitting rotation of the rod with respect to the member as the handle means is rotated for longitudinally moving the rod through the bore as the rod is rotated; and a retaining clip engagable with the member for retaining the driving member adjacent the bore of the member and for biasing the rod against rotational movement while the rod is driven longitudinally through the bore as the driving member is rotated with respect to the member, the retaining clip permitting rotation of the rod with respect to the member, as the handle means is rotated to overcome the bias of the retaining clip for longitudinally moving the rod through the bore as the rod rotates, the retaining clip supporting the driving member externally from the member with the driving member disposed adjacent one end of the bore through the member.

* * * * *